United States Patent [19]

Weismann

[11] 4,079,560

[45] Mar. 21, 1978

[54] WIRE TRUSS AND APPARATUS FOR MANUFACTURING A WIRE TRUSS

[76] Inventor: Victor Paul Weismann, 430 Prospect Cir., South Pasadena, Calif. 91030

[21] Appl. No.: 794,378

[22] Filed: May 6, 1977

Related U.S. Application Data

[63] Continuation-in-part of Ser. No. 646,607, Jan. 5, 1976, abandoned.

[51] Int. Cl.[2] ..... E04C 2/26

[52] U.S. Cl. ..... 52/309.7; 52/309.12; 52/410; 52/577

[58] Field of Search ..... 52/648, 646, 637, 643, 52/650, 657, 645, 690, 410, 577, 309.4, 309.7, 309.12; 182/179

[56] References Cited

U.S. PATENT DOCUMENTS

| | | | |
|---|---|---|---|
| 3,522,685 | 8/1970 | Oroschakoff | 52/648 |
| 3,879,908 | 4/1975 | Weismann | 52/410 |

FOREIGN PATENT DOCUMENTS

| | | | |
|---|---|---|---|
| 1,150,176 | 8/1957 | France | 52/648 |
| 1,355,456 | 2/1964 | France | 52/648 |

*Primary Examiner*—James L. Ridgill, Jr.
*Attorney, Agent, or Firm*—Christie, Parker & Hale

[57] ABSTRACT

A wire matrix for a construction panel has a plurality of parallel longitudinal trusses, each truss having a pair of parallel longitudinal wire runners and a plurality of transverse wire struts in which the struts associated with one truss are all parallel to each other and extend diagonally between the parallel runners, with the struts in alternate ones of the trusses being parallel and the struts in adjacent trusses being skewed. The trusses are formed by making a grid of parallel longitudinal runners joined by diagonal cross wires which are then cut between adjacent pairs of runners to form separate trusses. The trusses are then joined by transverse wire runners forming a three-dimensional matrix.

3 Claims, 5 Drawing Figures

WIRE TRUSS AND APPARATUS FOR MANUFACTURING A WIRE TRUSS

CROSS-REFERENCE TO RELATED APPLICATIONS

This application is a continuation-in-part of application Ser. No. 646,607 filed Jan. 5, 1976 now abandoned.

FIELD OF THE INVENTION

This invention relates to the manufacturing and construction of building panels, and more particularly, panels fabricated from wire and welded into a matrix framework.

BACKGROUND OF THE INVENTION

In U.S. Pat. No. 3,305,991 in the name of the present inventor, there is described a reinforced modular foam panel which consists of a three-dimensional lattice or matrix framework formed from steel wires welded together, with the interior volume of the lattice being filled with a hard-setting foam plastic material which surrounds and bonds to the internal braces of the lattice. As further described in U.S. Pat. No. 3,838,241, also in the name of the present inventor, there is described apparatus for manufacturing the wire framework. The present invention is directed to an improvement in both the construction of the wire framework for the panel and the apparatus for manufacturing the wire framework.

As described in the above patents, the framework is constructed by forming a plurality of wire trusses which are then arranged in parallel and joined by transverse wire runners to form a three-dimensional wire matrix. Each truss consists of parallel spaced runners joined by a plurality of spaced struts which extend diagonally between the spaced runners. The diagonal struts extend alternately in opposing directions so as to form a zigzag pattern along the length of the truss. In addition, close-out struts at the end of each truss section are provided which extend perpendicular to the two runners. While this construction results in a rigid highly satisfactory wire framework, this design has required that the trusses be individually constructed. Since each panel utilizes a large number of parallel trusses, a large number of truss-making machines is necessary to keep up with a single matrix framework fabricating apparatus on a continuous basis.

SUMMARY OF THE INVENTION

The present invention is directed to an improved turss design which lends itself to manufacturing a number of trusses simultaneously on a single machine. This is accomplished, in brief, by providing a machine in which a plurality of wires are moved along in spaced parallel relationship in a common plane by a supporting conveyor, the wires being alternately spaced close together and farther apart. Cross wires are successively laid on the moving parallel wires at regularly spaced locations along the path of movement of the parallel wires, the cross wires extending in a diagonally transverse direction. The intersecting points between the parallel wires and the cross wires are welded to form a wire grid. The cross wires are then cut between the closely spaced parallel wires to divide the grid into separate trusses, each consisting of a pair of spaced apart parallel wires joined by diagonally extending cross-wire struts that are all parallel to each other.

The resulting essentially planar trusses are then formed into a matrix framework by twisting the trusses about the longitudinal axis through 90° so that the planes defined by the parallel wires of each truss are arranged parallel to each other. The trusses are alternately twisted clockwise and counterclockwise by 90° so that the diagonal direction of the cross struts of adjacent trusses extend in opposite directions from each other.

DESCRIPTION OF THE DRAWINGS

For a more complete understanding of the invention, reference should be made to the accompanying drawings, wherein.

DETAILED DESCRIPTION

Figure 1:
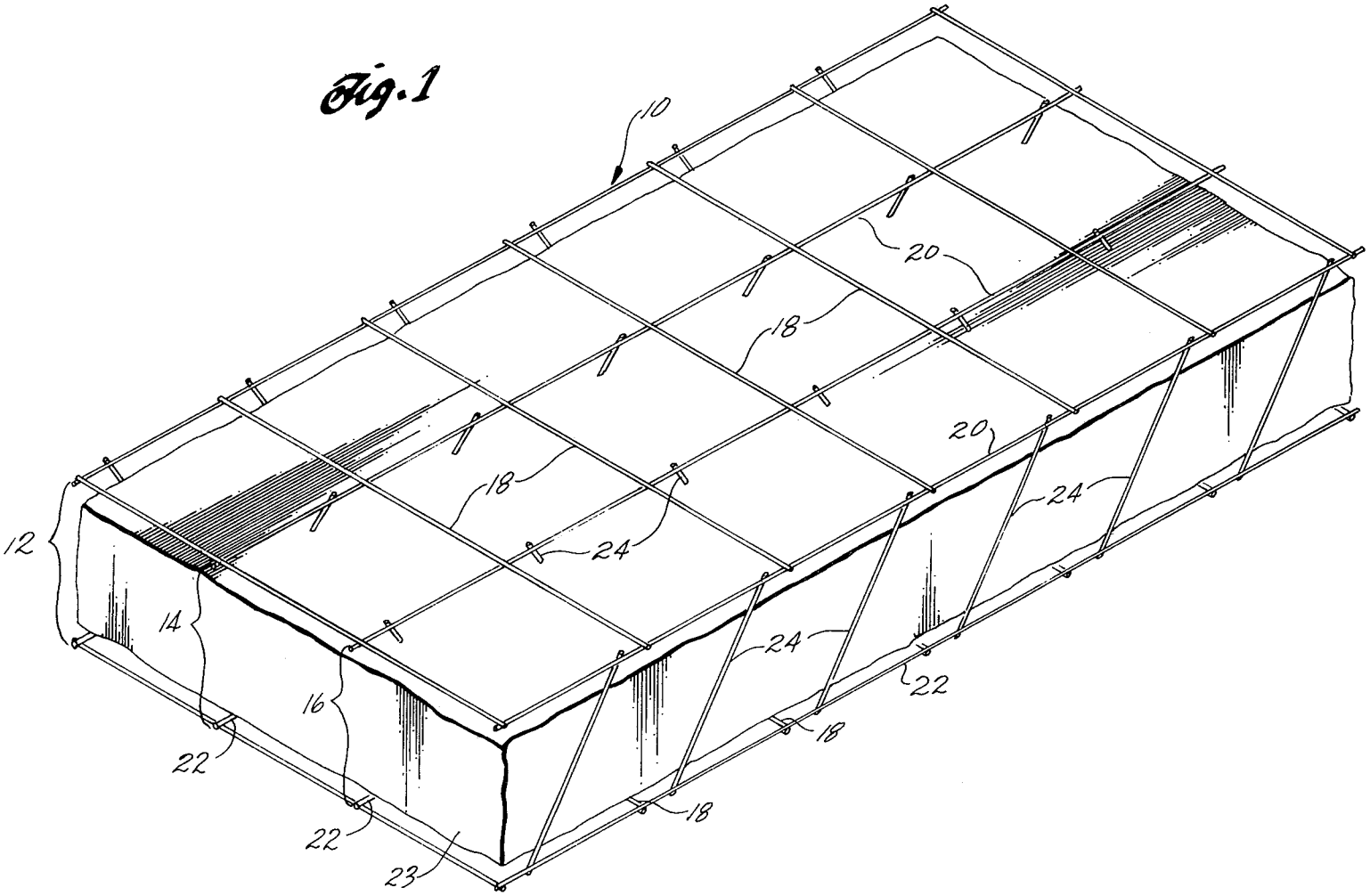
FIG. 1 is a perspective view to scale of a panel wire framework according to the present invention.

Referring to FIG. 1, the numeral 10 indicates generally a wire grid or matrix framework in three-dimensional form. The framework 10 is formed by securing a group of parallel truss members, such as indicated at 12, 14, and 16, in spaced parallel relationship by a plurality of transverse steel wire members 18 which are also arranged in spaced parallel relationship to each other and are perpendicular to the planes defined by the parallel truss members. Each truss, according to the present invention, comprises a pair of spaced apart parallel wire runners 20 and 22 with a plurality of connecting wire struts 24 being secured at their opposite ends to the runners 20 and 22. All of the struts in a single truss are parallel to each other and extend diagonally relative to the runners 20 and 22. The trusses are arranged so that the diagonal direction of the struts is reversed in adjacent trusses, thus providing added rigidity to the framework.

In a completed building panel, the interior of matrix 10 is filled with a body of unicellular rigid foam material 23 which is foamed in situ in the matrix to bond to the several struts 24 within the perimeter of the matrix. As described in U.S. Pat. No. 3,305,991, the bonding of the foam material to the struts imparts additional structural integrity to the matrix and enhances its load-bearing characteristics while providing a building panel which has inherent sound and thermal insulating properties and is impervious to moisture. The bond of the foam material to the matrix elements is accomplished by foaming and setting the foam material in situ in the matrix; see my prior U.S. Pat. No. 3,555,131. A preferred foam material is polyurethane foam. A typical building panel is four feet wide by eight feet long by two inches thick, although panels of any width, length or thickness desired are within the scope of this invention.

Figure 2:
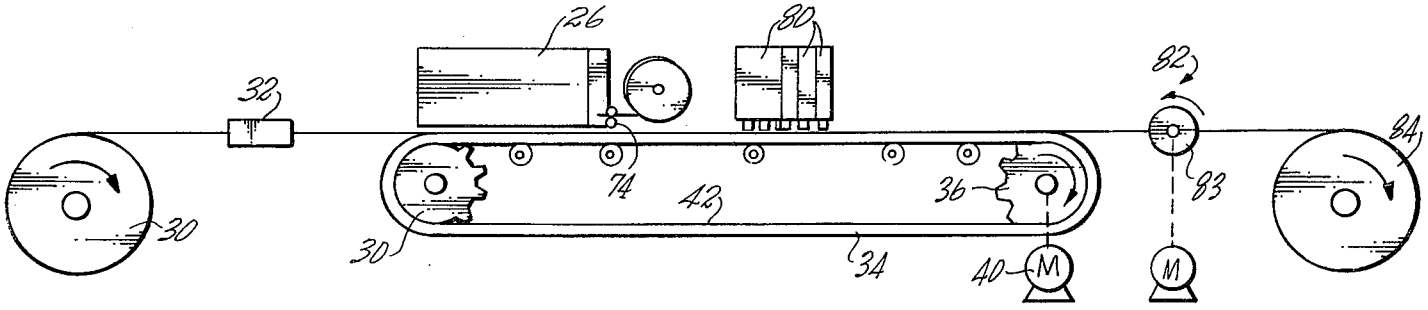
FIG. 2 is a simplified elevational view of the apparatus for manufacturing the trusses in the matrix framework of FIG. 1.

By providing wire trusses for the framework in which all the struts extend diagonally in the same direction relative to the parallel runners, it is possible to fabricate the trusses by forming a continuous grid which can be then split into a plurality of individual longitudinal trusses. The apparatus for manufacturing the wire trusses is shown in detail in FIGS. 2, 3 and 4. A plurality of coils of wire 30 are rotatably mounted on a common axis. The wires 31 from each of the coils pass through straighteners 32. The wires, which form the runners of the trusses being fabricated, are guided from the straighteners onto the top surface of a conveyor 34. The conveyor is in the form of a closed loop extending around sprockets 36 and 38 at either end. The sprocket 36 is driven from a suitable motor drive 40.

Figure 3:
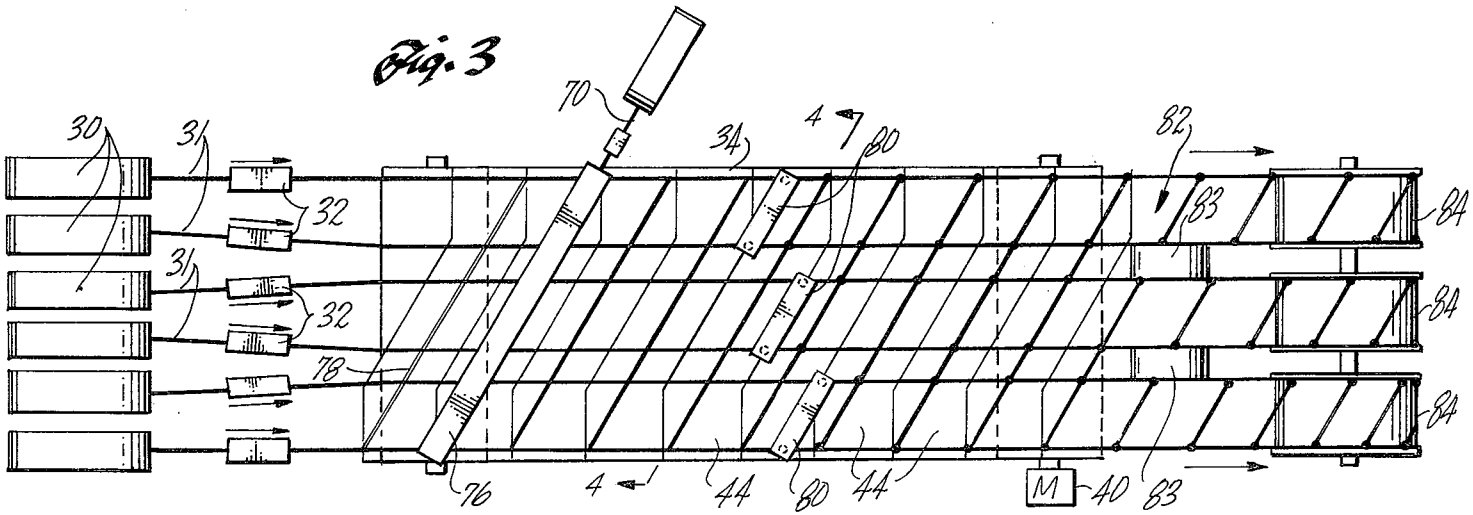
FIG. 3 is a simplified top view of the apparatus of FIG. 2.
Figure 4:
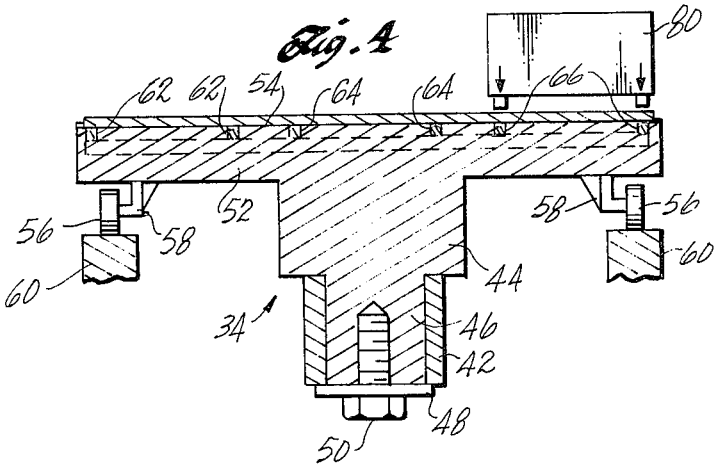
FIG. 4 is a sectional view taken on the line 4—4 of FIG. 3.

FIG. 1 is a perspective drawing which is to scale and which illustrates that a common spacing is used between individual struts 24 in a given truss, between the longitudinal runners 20 and 22 in each truss, between the several trusses, and between the transverse members 18 as connected to truss runners 20 and 22. FIG. 3 also shows that the spacing between the longitudinal runners in each truss preferably is equal to the spacing between the struts of each truss. The presently preferred common spacing as described above is two inches.

The construction of the conveyor system is preferably as described in detail in the above-identified U.S. Pat. No. 3,838,241. Thus the conveyor 34 includes a link chain 42 extending down the center of the conveyor to which are secured a plurality of electrically non-conductive T-shaped blocks 44. A center section 46 of each T-shaped block 44 extends down between the links of the drive chain 42 to which the block is removably clamped by a washer 48 and bolt 50. The top cross member 52 of the T-shaped block 44 extends horizontally on either side providing a flat outer surface 54. Transverse lateral margins of the top surface 54 extend at an angle to the path of movement of the conveyor, which angle corresponds to the diagonal angle between the cross struts and the runners of the truss, as described above in connection with FIG. 1. Rollers 56, supported on either end of the cross member 52 by brackets 58, ride on supporting rails or other suitable guide surfaces, as indicated at 60. Thus adjacent blocks 44 form a continuous flat horizontal surface rolling on guide surfaces 60 as they are moved along by the chain 42.

The surface 54 of each of the blocks 44 is provided with a plurality of pairs of parallel grooves, such as indicated at 62, 64 and 66, extending in the direction of motion of the conveyor. The grooves of each pair are spaced apart a distance corresponding to the spacing between the longitudinal runners 20 and 22 of a single wire truss. The spacing between adjacent pairs of grooves is substantially less.

The wire stock from the coils 30 is directed by wire guides into the respective parallel grooves 62, 64 and 66, the wires moving along with the conveyor from the coils in a continuous feed arrangement. The blocks 44 are continuously recirculated by the conveyor chain. A cross wire feed station is provided which includes a coil of wire 70 which is drawn from the coil through a straightener 72 by feed rolls 74 along a path parallel to the diagonal margins of the adjacent blocks 44. A cutoff unit 76 cuts off the cross wire feed stock when enough wire has been extended to bridge the width of the conveyor. The lengths of wire as they are cut off drop onto the conveyor and are urged into diagonal slots 78 in the surfaces 54 of the blocks 44. The rate of feed of the cross wire stock is synchronized with the rate of feed of the runners and the conveyor belt 34 so that a strut wire is cut off from the cross feed as each block passes beneath the cross-feed station. Thus the slot 78 in each block is loaded with a wire strut as it is moved by the conveyor past the cross-feed station.

Each block 44, with wire runners positioned in the parallel slots 62, 64 and 66, and with a wire strut positioned in the diagonal slot 78, is moved by the conveyor under a welding station 80 where the strut wire is welded to each of the runners at the points of intersection by resistance welding techniques, such as described in more detail in the above-identified U.S. Pat. No. 3,838,241. Thus a wire grid structure is formed having a plurality of pairs of longitudinal runners and with equally spaced diagonally extending strut wires.

The welded grid is then moved by the conveyor past a slitting and trimming station 82. The station 82 includes suitable means 83, such as high-speed grinding wheels, cutting wheels, or the like, which cut off the struts in the space between the adjacent pairs of longitudinal runners. In this manner the grid is split into a plurality of parallel continuous wire trusses. These may be wound on suitable reels 84 or fed directly to a matrix fabricating machine, such as shown in FIG. 5.

Figure 5:
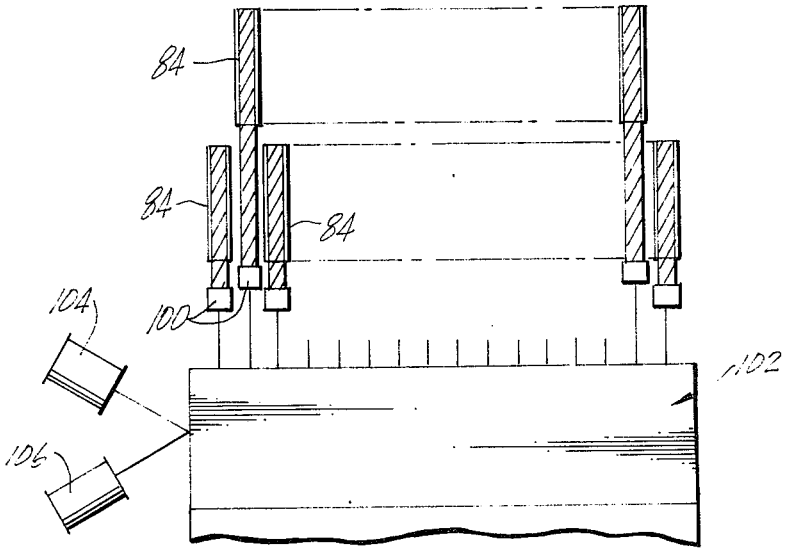
FIG. 5 is a simplified plan view of the matrix framework fabrication apparatus.

Referring to FIG. 5, the wire trusses, after being stored on reels by the above-described truss fabricating apparatus, are loaded on the matrix framework fabrication apparatus which is of a type described in detail in the above-identified U.S. Pat. No. 3,838,241. The reels of wire trusses 84 feed the trusses through an associated twisting and feeding mechanism 100. The twisting mechanism operates to rotate the plane of the wire truss as it comes off the roller through 90°, so that the planes of all of the wire trusses entering the matrix fabricating machine are parallel to each other and perpendicular to a common plane. It is important to note that alternate twisting mechanisms rotate in opposite rotary direction so that the diagonal struts in adjacent trusses extend in opposite diagonal directions relative to each other.

The parallel trusses are joined together in the matrix framework fabricating machine, indicated generally at 102, by wire cross runners derived from wire stock reels 104 and 106. Cross runners are welded to the longitudinal runners of the trusses to form the transverse runners 18, as shown in FIG. 1.

From the above description it will be appreciated that an improved apparatus is provided for forming wire trusses and assembling them into a wire matrix framework. By utilizing wire trusses in which the cross struts are all parallel and extend diagonally in the same direction, the trusses can be manufactured initially in the form of a two-dimensional grid which can then be split or cut into individual lengths of wire trusses. This permits a larger number of wire trusses to be manufactured simultaneously on a single machine by a continuous process. While the preferred embodiment has been shown as fabricating three wire trusses in parallel, it will be understood that this number is by way of example only.

What is claimed is:

1. A construction panel comprising:

a metal wire lattice type framework including a plurality of spaced parallel essentially planar longitudinal trusses, each truss consisting of an upper and a parallel lower longitudinal wire runner and a plurality of transverse wire struts, each strut being secured to the upper and lower runners of its truss, all of the struts associated with one truss being parallel to each other and extending diagonally at an acute angle relative to the runners, and a plurality of upper and lower transverse wire runners intersecting respectively the upper and lower runners of the trusses, the longitudinal and transverse runners being joined at their intersections, the struts in every second one of the trusses extending diagonally in one direction and the struts in the intermediate trusses extending diagonally in the opposite direction so that the struts in one truss are askew to the struts in each adjacent truss.

2. The panel of claim 1 having a unitary mass of rigid plastic foam material embedded in the framework, the material surrounding and being bonded to the struts.

3. A panel according to claim 1 in which the struts and the transverse runners are regularly spaced along the trusses, and the regular spacing of the truss struts and the transverse runners is essentially equal to the spacing between the upper and lower longitudinal runners in each truss.

* * * * *